United States Patent [19]

Arnason et al.

[11] 4,136,003

[45] Jan. 23, 1979

[54] CELL FOR FUSED-SALT ELECTROLYSIS WITH GAS COLLECTING MEANS

[75] Inventors: Tomas Arnason, Essen; Rudolf Blaska, Bottrop, both of Germany

[73] Assignee: Swiss Aluminum Ltd., Neuhausen am Rhienfall, Switzerland

[21] Appl. No.: 894,310

[22] Filed: Apr. 7, 1978

Related U.S. Application Data

[63] Continuation-in-part of Ser. No. 838,431, Sep. 30, 1977, abandoned, which is a continuation of Ser. No. 645,115, Dec. 29, 1975, abandoned.

[30] Foreign Application Priority Data

Mar. 10, 1975 [DE] Fed. Rep. of Germany ..... 2510400

[51] Int. Cl.[2] ..... C25C 3/06; C25C 3/22

[52] U.S. Cl. ..... 204/247

[58] Field of Search ..... 204/243 R–247, 204/67

[56] References Cited

U.S. PATENT DOCUMENTS

| | | | |
|---|---|---|---|
| 3,912,615 | 10/1975 | Minchenko | 204/243 R |
| 3,935,090 | 1/1976 | Petrusenko et al. | 204/243 R |

FOREIGN PATENT DOCUMENTS

| | | | |
|---|---|---|---|
| 246074 | 3/1970 | U.S.S.R. | 204/243 R |
| 258608 | 10/1970 | U.S.S.R. | 204/243 R |
| 261700 | 11/1970 | U.S.S.R. | 204/247 |
| 304315 | 7/1971 | U.S.S.R. | 204/243 R |

*Primary Examiner*—John H. Mack
*Assistant Examiner*—D. R. Valentine
*Attorney, Agent, or Firm*—Sprung, Felfe, Horn, Lynch & Kramer

[57] ABSTRACT

A cell for fused-salt electrolysis for reducing alumina in the presence of cryolite to metallic aluminum. The cell includes an insulated tank having a carbon bottom, two rows of anode rods disposed on opposite sides of an anode carrier positioned in the longitudinal center plane, an exhaust gas-collecting duct extending at the longitudinal center between the two rows of anode and covers downwardly inclined from the outside of respective rows of anode rods to respective edges of the tank and provided at the outer longitudinal edge and the transverse edges with a skirt that extends to the respective edge of the tank. Each cover is hinged adjacent to its longitudinal edge adjacent to the anodes and at least at its corner portions to a support which extends along the row of anode rods. A carrying arm is secured to each end portion of the support and is pivoted at its other end to the anode carrier. The carrying arm is connected by an operating linkage to a piston rod of a cylinder of a hydraulic or pneumatic actuator. A second cylinder of a second hydraulic or pneumatic actuator is pivoted to the support at least adjacent to the middle thereof and the piston rod of the second actuator engages the cover.

9 Claims, 5 Drawing Figures

CELL FOR FUSED-SALT ELECTROLYSIS WITH GAS COLLECTING MEANS

This application is a continuation-in-part-application of U.S. application Ser. No. 838,431, filed Sept. 30, 1977, which is a continuation of U.S. application Ser. No. 645,115, filed Dec. 29, 1975 both now abandoned.

BACKGROUND

This invention relates to a cell for fused-salt electrolysis for reducing alumina in the presence of cryolite to metallic aluminum, comprising an insulated tank, which has a carbon bottom, two rows of anode rods, which are disposed on opposite sides of an anode carrier, which is arranged in the longitudinal center plane, an exhaust gas-collecting duct extending at the longitudinal center between the two rows of anode rods, and two covers, which are downwardly inclined from the outside of respective rows of anode rods to respective longitudinal edges of the tank and which are provided each at its outer longitudinal edge and at each of its transverse edges with a skirt that extends as far as to the respective edge of the tank.

The exhaust gases formed in the electrochemical process of recovering aluminum from alumina contain fluorine, which is a product of the reaction of the cryolite in the electrolytic cell, and finely divided carbon, which released by the carbon anodes. For ecological reasons, it is essential to reduce particularly the fluorine content in the exhaust gases to the utmost minimum before such gases are discharged into the atmosphere so that the environment is not adversely affected.

It is known for this purpose to purify the exhaust air which escapes from the buildings which contain plants for fused-salt electrolysis — this air contains the exhaust gases — and then to discharge the air in an ecologically innocuous state. To this end the natural chimmey action in the buildings is utilized to move the air in the buildings, which contains the exhaust gases from the electrolysis, to mechanical means, such as blowers, purifiers or the like, which are mounted on the roofs and serve to discharge the emissions. The purifiers consist essentially of liquid-wetted filters, between which a mist is maintained so that dust particles and gaseous constituents are retained by the filters and by the liquid particles and the purified air is discharged into the atmosphere.

Whereas the mechanical means which are available at present can handle and purify all air in the buildings, they do not decisively improve the conditions within the building from the aspect of work hygiene.

To maintain the concentration of the noxious exhaust gases which escape from the cells for fused-salt electrolysis within tolerable limits, it is known to provide the cells for fused-salt electrolysis with a cover. This cover consists of a collecting duct, which extends longitudinally between the rows of anode rods and which is provided at its outer periphery with two cover plates, which are downwardly inclined toward the longitudinal side of the tank. The anode rods extend through the cover plates and those edge portions of the cover plates which are near the longitudinal sides of the tank closely embrace the anode blocks so that an uncovered surface of the electrolytic cell remains exposed between the inside periphery of the tank and the outside edge of the cover plates and permits of an access to the interior of the cell whereas the exhaust gases from the cell can be sucked off only from a relatively small part thereof.

It is known to eliminate this disadvantage by the use of a cell for fused-salt electrolysis in which the cover plates are mounted on a tube which is longitudinally bisected and which engages the upper portion of the periphery of the cylindrical exhaust gas-collecting duct. Hinged plates are mounted at the outside edges of the cover plates and rest on the longitudinal edges of the tank. The rate at which exhaust gases escape into the air in the building is much reduced by this arrangement.

On the other hand, the arrangement has the disadvantage that these means must be entirely removed for a replacement of the anode.

For this reason it has been proposed (Opened German Specification No. 2,251,898) so to design the cover that the same must be opened only when it is desired to charge the cell and to remove the molten aluminum. This object is accomplished in that the cover covers the anodes on their vertically extending sides, transverse walls intended to rest on the ends of the tank are mounted on the cover, and the anodes consist of continuous anodes. This arrangement is not highly suitable where so-called manipulators are to be used, which can, e.g., automatically break up the slag crust, and feed the alumina to the cell. Besides, the arrangement requires the use of continuous anodes.

SUMMARY

The invention provides a cell for fused-salt electrolysis with covers which are so designed that the electrolytic cell can be operated in a simple manner by a manipulator, the molten material can be removed without obstruction, the anodes can be replaced without special difficulties, and particularly tight covers are also provided.

This object is accomplished by constructing the cover, which on the longitudinal sides of the lowerable anode carrier extends inclined to the cathode tank, in two parts, the lower, pivoting part of the cover being hinged in the vicinity of its longitudinal edge adjacent to the anodes, or at least in its corner portions, to a support which extend along the row of anode rods and which is rigidly connected at least by its end portions to carrying arms pivoted to bearing brackets mounted on the lowerable anode carrier, the second part of the cover, disposed between the support and anode carrier, being constructed essentially to abut on the lowerable anode carrier.

Because the entire anode carrier descends slowly as the anodes are consumed, the fixation of the bearing bracket to the anode carrier ensures that there will be no relative movement between the anode carrier and the cover so that the structure is very tight.

At least adjacent to the middle of the support, the cylinder of a pneumatic actuator is pivoted to an abutment mounted on the support and the piston rod of said actuator is movably connected to the cover. This actuator is operable to impart a sufficient upward pivotal movement to the cover when it is desired to charge the cell for fused-salt electrolysis and to remove the molten aluminum.

The lower cover is appropriately secured to the upper cover by means of a plurality of brackets. The piston rod of the cylinder, which is mounted on the middle carrying arm and actuates the movement of the lower cover, may then be secured to one of the brackets.

Fastening means for a hoisting device may be attached to the two middle carrying arms in the center portion of the upper cover.

In accordance with an advantageous mode of construction of the apparatus in accordance with the invention, the two-part control linkage which is connected to the piston rod of a pneumatic of hydraulic cylinder mounted on the anode carrier engages at least one carrying arm. The part of the linkage which is connected to the piston of the linkage then is pivotably connected to the bearing bracket.

In accordance with another, likewise advantageous mode of construction, fastening means for a hoisting device are provided at least on the middle cantilevers.

Both arrangements permit the raised cover to be raised further when the anodes are to be replaced, thus making the anodes readily accessible.

According to a special feature of the invention, U-shaped anode rod seals are disposed on that side of the support which faces the exhaust gas-collection duct, which extends as far as to the anode rods, and these seals embrace the anode rods and positively engage the same so that the seals can adjust themselves to the instantaneous position of the anode rods, which is not exactly fixed.

Each anode rod seal consists of a sliding element, which positively embraces the anode rod and which is horizontally slidably mounted in a guide which is mounted on a baseplate.

DESCRIPTION OF THE DRAWINGS

The apparatus in accordance with the invention is shown in the drawing by way of example and is explained in detail below.

DESCRIPTION

Figure 1:
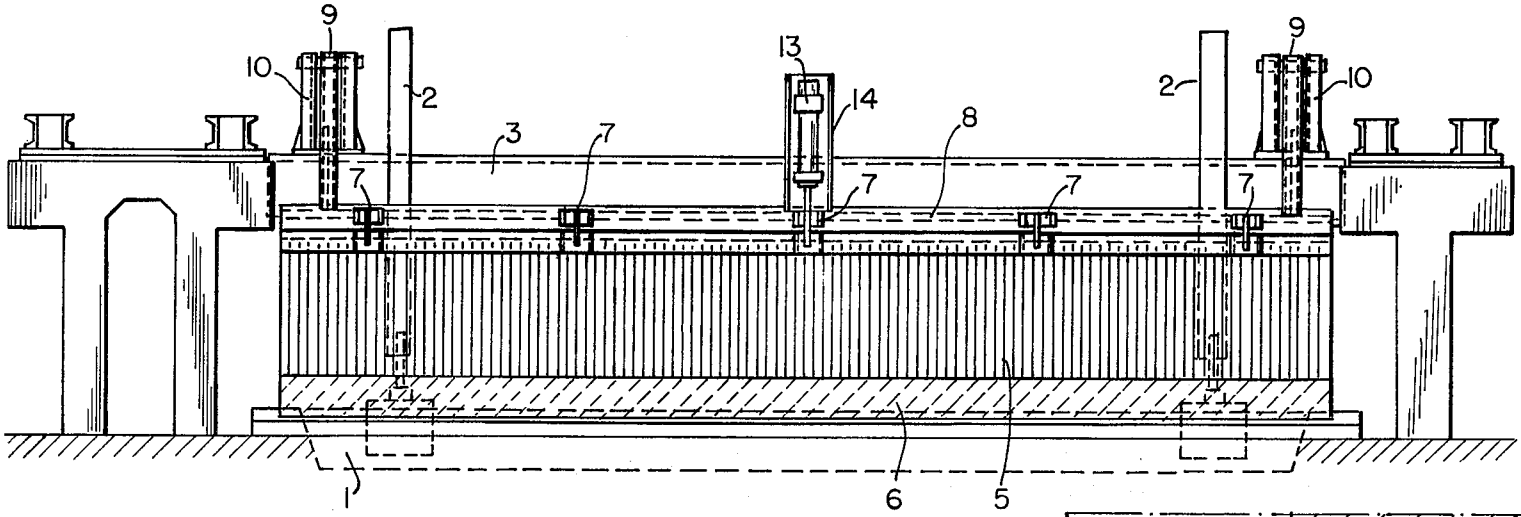
FIG. 1 is a front elevation of the cover in the closed position.

The anode carrier 3 carrying the anode rods 2 is disposed over the cell 1 for fused-salt electrolysis and extends in the longitudinal center plane of the cell, exhaust gas collection ducts 4 being provided between the two rows of anodes. A sheet or plate-like two-part cover 5 and **5*a* extends downwardly inclined from each row of anodes to the longitudinal edge of the electrolytic cell 1. Skirts 6 of asbestos are mounted on the longitudinal edge and the later edges of the lower cover 5*a* and rest on the longitudinal edge and the lateral edges of the electrolytic cell 1 and prevent the escape of exhaust gases in this area. Carrying arms 9 are secured to the support tube 8 both at its end portions and at its center, the other end of each carrying arm being pivoted to a bearing bracket 10 mounted on the anode carrier 3**.

Figure 2:
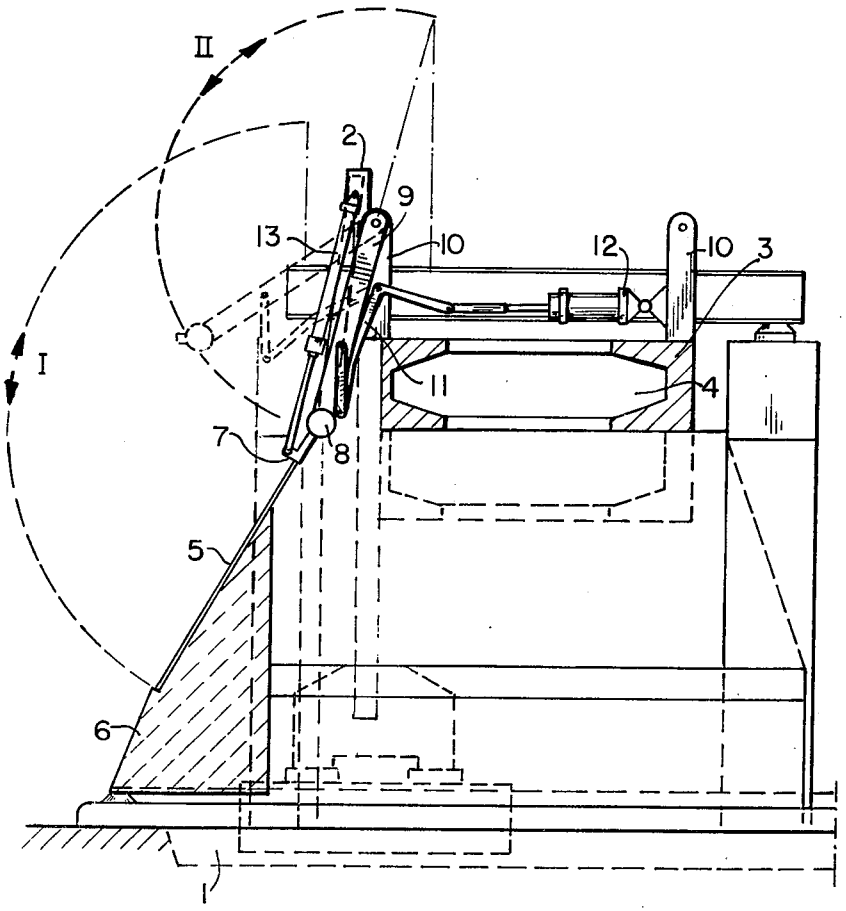
FIG. 2 is a side elevation of the cover in the closed position, with a cylinder mounted on the anode carrier and with a control linkage

According to FIG. 2, a two-link control linkage 11 connected to the piston rod of a pneumatic cylinder 12 mounted on the anode carrier 3 engages the carrying arm 8. The part of the linkage which is articulated to the cylinder 12 is pivoted to the bearing bracket 10.

Disposed at the center of the support tube 8 is an abutment 14 to which the end of a hydraulic or pneumatic cylinder 13 is pivoted, the piston rod of said cylinder being pivoted to a bracket 7 mounted on the cover 5.

Figure 3:
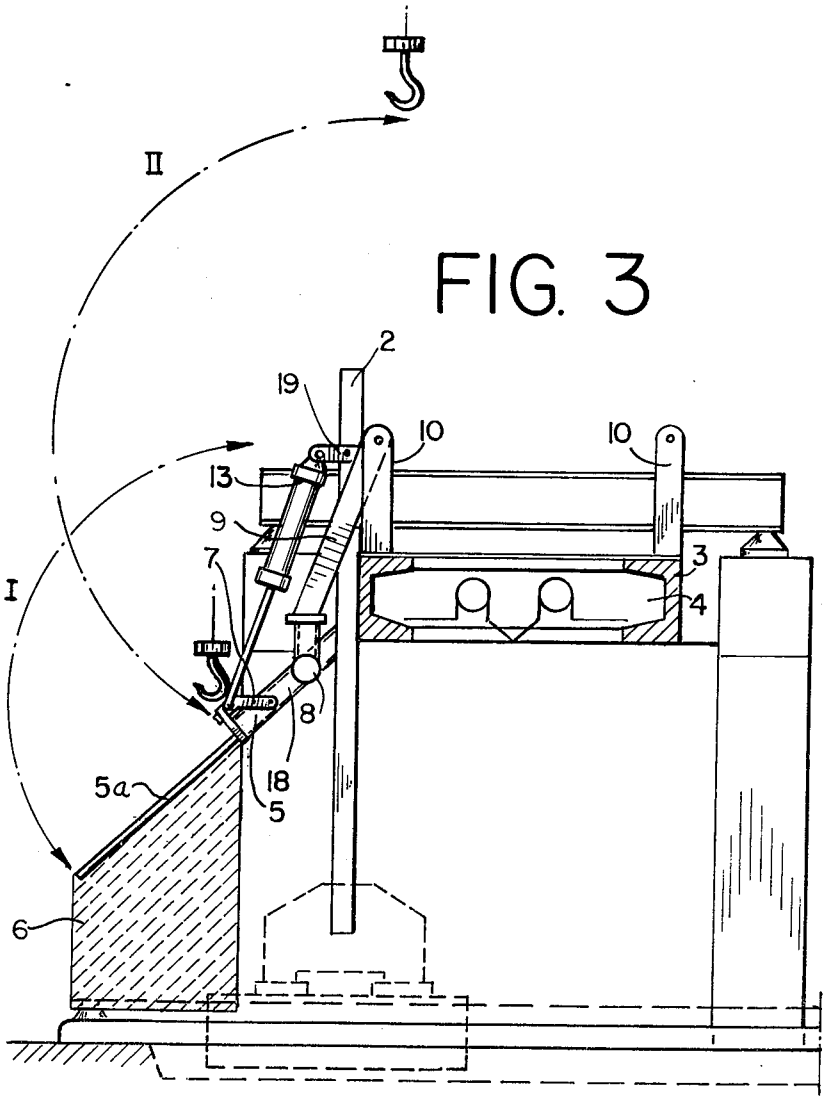
FIG. 3 is a side elevation of the cover in the closed position, with fastening means for a hoisting device.

In a mode of construction according to FIG. 3, fastening means for a hoisting device are provided on at least one cantilever 18 in the center protion of the upper cover. The lower cover **5*a* is pivotably connected by means of brackets 7 to said cantilver or cantilevers 18, disposed in the vicinity of the longitudinal edge of the lower cover 5*a*** which is adjacent to the anodes.

Disposed on the middle carrying arm 9 is a bearing 19 to which the end of the hydraulic or penumatic cylinder 13 is pivotably connected, the piston rod of the cylinder being pivoted to the bracket 7.

Pivotal movement I is imparted to the cover by the cylinder 13, and pivotal movement II by the shop crane or by the control linkage 11.

As shown in FIG. 2, the pivot axis at the upper end a of element 11 is fixed on bearing bracket 10. The ends b and c are connected to the other linkages at movable pivot points. Pivot point d is fixed on arm 9.

As can be seen from FIGS. 1 and 2, the whole structure is carried by the anode carrier 3. The anode carrier descends with the velocity corresponding to the anode consumption and thus the whole structure vertically descends with a velocity corresponding to this anode consumption. Thusly, the asbestos skirts 6 prevent the cover 5 from losing its tight fit because, as shown, the skirts are flexibly thin. From this it is clear that there is no relative movement between the structure or parts of the structure and the anode carrier during the descension.

As can be further seen from FIGS. 1 and 2, the abutment 14 is fixed onto the support arm 8 and moves in the same way as support arm 8, which means there is no relative movement between abutment 14 and support arm 8. When cylinder 13, which is moveably fixed onto abutment 14, moves, only the cover 5 is moved in art I.

The arrangement according to the invention permits of a control of each cover in such a manner that the pneumatic actuator comprising the cylinder 13 is operated to impart an upward pivotal movement to the cover 5 when it is desired to perform general operations in the cell, such as breaking crusts, charging alumina, ladling molten metal and checking the cells. For a replacement of anodes, a further upward pivotal movement, beyond the vertical position, is imparted to the previously raised cover 5 about the pivotal axis of the carrying arm 9.

Figure 5:
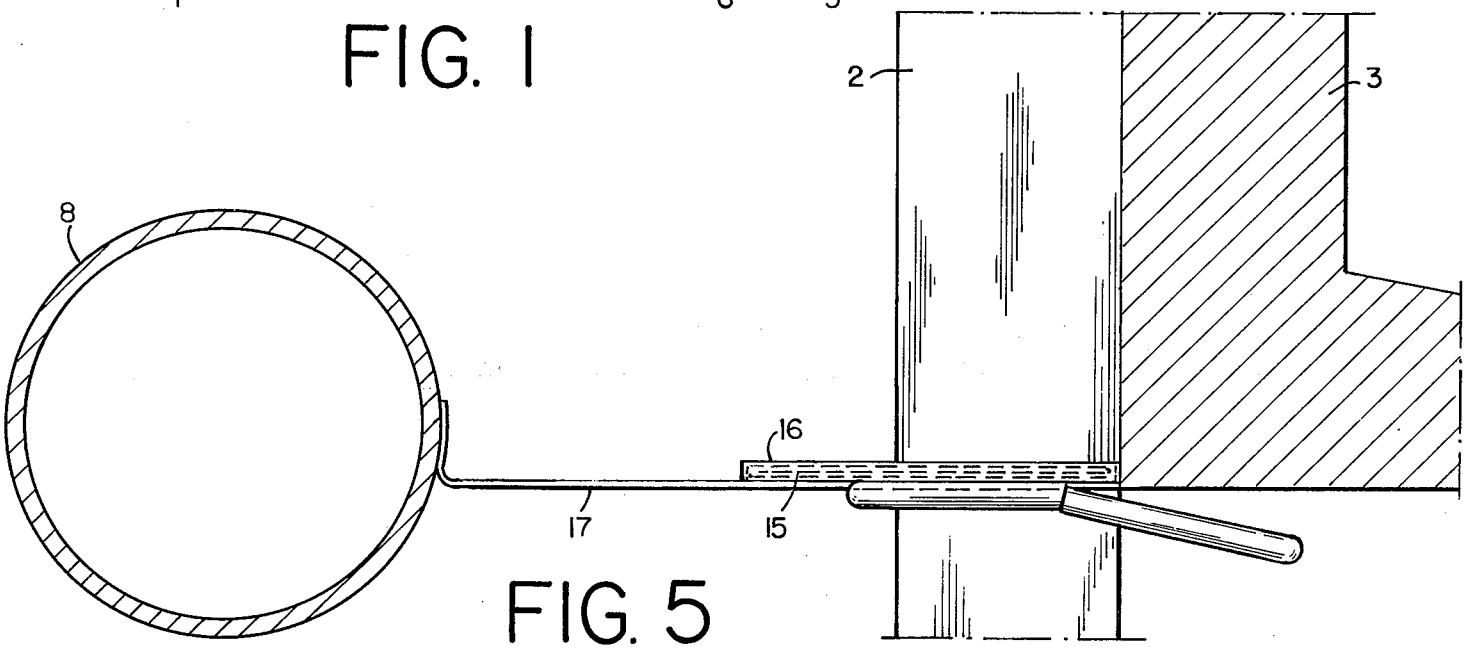
FIG. 5 is a side elevation of the anode-rod seal.
Figure 4:
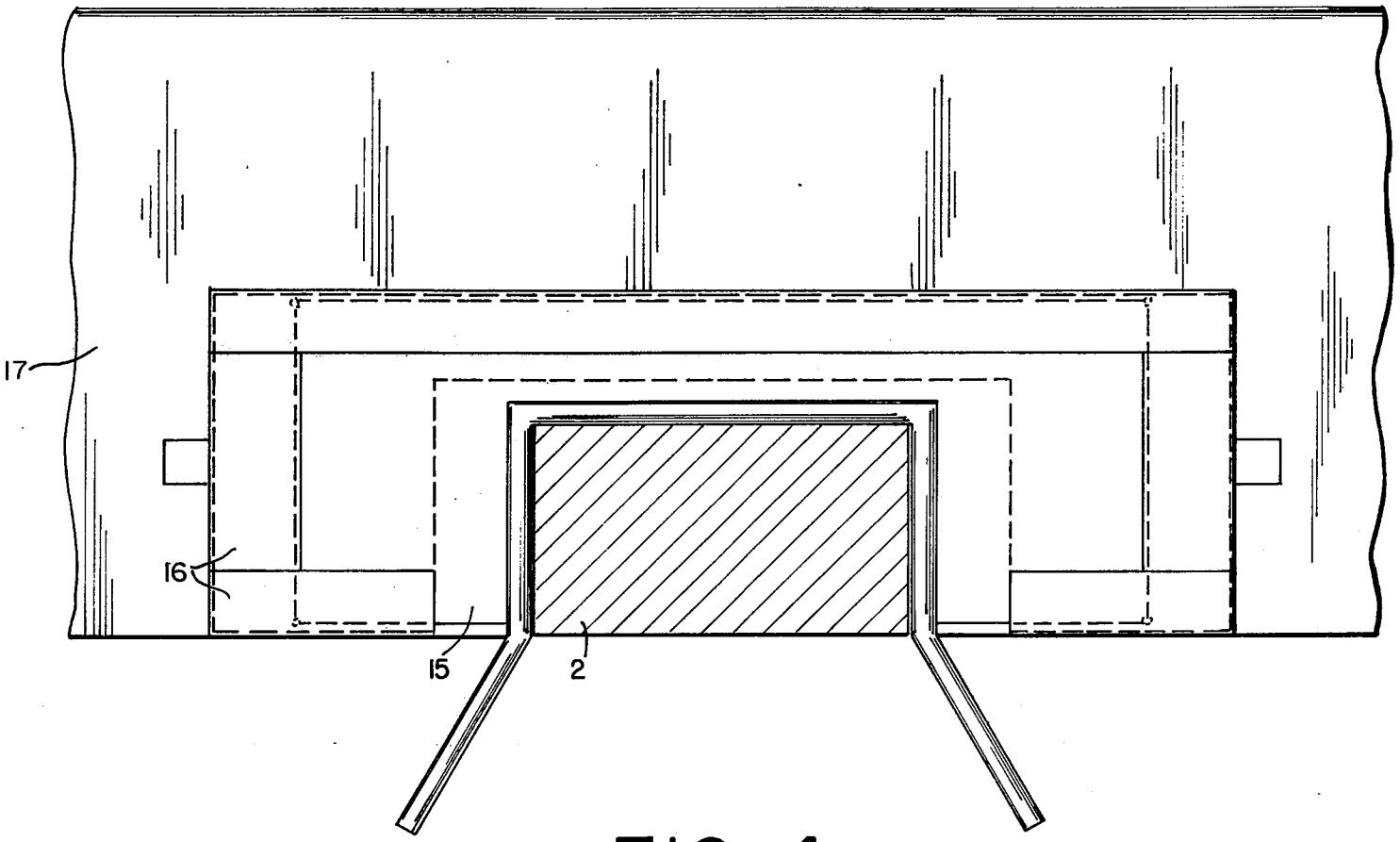
FIG. 4 shows a slidable anode-rod seal.

FIGS. 4 and 5 show the seals between the anode rods and the cover. The anode rod 2 is positively embranced by a horizontally slidable element 15, which is slidably mounted in a guide 16 on a baseplate 17. The baseplate is secured to the supporting tube 8 and directly engages the anode carrier 3.

It will be appreciated that the instant specification and example are set forth by way of illustration and not limitation, and that various modifications and changes may be made without departing from the spirit and scope of the present invention.

What is claimed is:

1. A cell for fused-salt electrolysis for reducing alumina in the presence of cryolite to metallic aluminum, comprising an insulated tank having a carbon bottom, an anode carrier arranged in the longitudinal center plane and movable downwardly during use, two rows of anode rods disposed on opposite sides of the anode carrier, an exhaust-gas collecting duct extending in the longitudinal center between the two rows of anode rods, and a plate-like cover inclined downwardly from the outside of each row of anode rods to the longitudinal edges of the tank and provided both at its longitudinal edge adjacent to the tank and at its transverse edges with a skirt extending as far as the edge of the tank, a support extending along the rows of anode rods, bearing brackets mounted on the anode carrier and carrying arms pivotally mounted on the bearing brackets, wherein the cover extends at an inclination to the cathode tank on the longitudinal sides of the anode carrier and comprises two parts, a lower pivotable part, hinged on at least a portion of its longitudinal edge portion adjacent to the anode rods to the support which is rigidly connected at least in its end portions to the carrying arms and a second cover part disposed between the support and the anode carrier and abutting the anode carrier.

2. A cell for fused-salt electrolysis according to claim 1, wherein the support is tubular and the lower part of the cover is hinged by brackets to the tubular support.

3. A cell for fused-salt electrolysis according to claim 1, further comprising cantilevers connected to the lower part of the cover to pivotably move same.

4. A cell for fused-salt electrolysis according to claim 1 further comprising a cylinder with an abutment mounted on the support, and a piston rod for the cylinder pivotably connected to a bracket for pivotally moving the lower part of the cover.

5. A cell for fused-salt electrolysis according to claim 2, further comprising a bearing disposed on the middlemost carrying arm, a cyclinder pivotally secured to the bearing the piston rod of the cylinder being likewise pivotably connected to the brackets.

6. A cell for fused-salt electrolysis according to claim 1 further comprising a cylinder mounted on the anode carrier, a two-part control linkage connected to the piston rod of the cylinder and engaging at least one carrying arm and a bearing bracket pivotally connected to the part of said linkage which is connected to the piston of the cylinder.

7. A cell for fused-salt electroylsis according to one of claim 3, further comprising fastening means for a hoisting device are provided on at least one of the intermediate cantilevers.

8. A cell for fused-salt electrolysis according to claim 1, further comprising U-shaped anode seals which positively embrace the anodes and are secured to the support on the side thereof adjacent to the anodes.

9. A cell for fused-salt electrolysis according to claim 8, wherein the anode seal comprises a baseplate connected to the support, a guide mounted on the baseplate and a slidable member which is horizontally slidable in the guide.

* * * * *